United States Patent [19]

Jurgich

[11] Patent Number: 5,065,896

[45] Date of Patent: Nov. 19, 1991

[54] LABEL DISPENSER

[76] Inventor: Donald Jurgich, P.O. Box 1575, Poulsbo, Wash. 98370

[21] Appl. No.: 646,077

[22] Filed: Jan. 25, 1991

[51] Int. Cl.[5] ..... B65H 5/28

[52] U.S. Cl. ..... 221/73; 156/465; 156/541

[58] Field of Search ..... 156/443, 459, 465, 540, 156/541, 542, 543; 221/25, 70, 71, 72, 73, 296

[56] References Cited

U.S. PATENT DOCUMENTS 3,283,886 11/1986 Addis et al. ..... 221/70 X 4,624,734 11/1986 Voltmer et al. ..... 221/73 X

*Primary Examiner*—D. Glenn Dayoan

*Assistant Examiner*—Dean A. Richard

*Attorney, Agent, or Firm*—Seed and Berry

[57] ABSTRACT

A label dispenser for stripping adhesive-backed labels from a dispensing strip which has a stripping edge extending at an acute angle with respect to a feed path. The dispensing strip passes from the stripping edge crosswise beneath the feed path after label removal has been performed.

13 Claims, 2 Drawing Sheets

FIG. 1
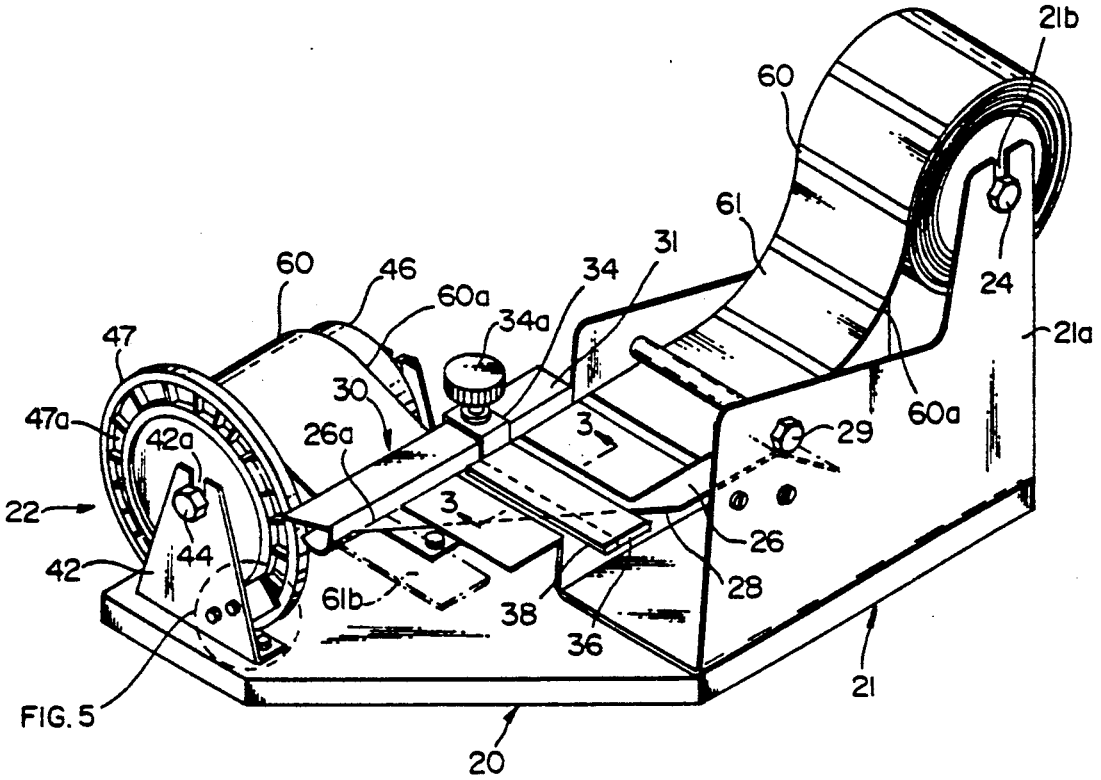
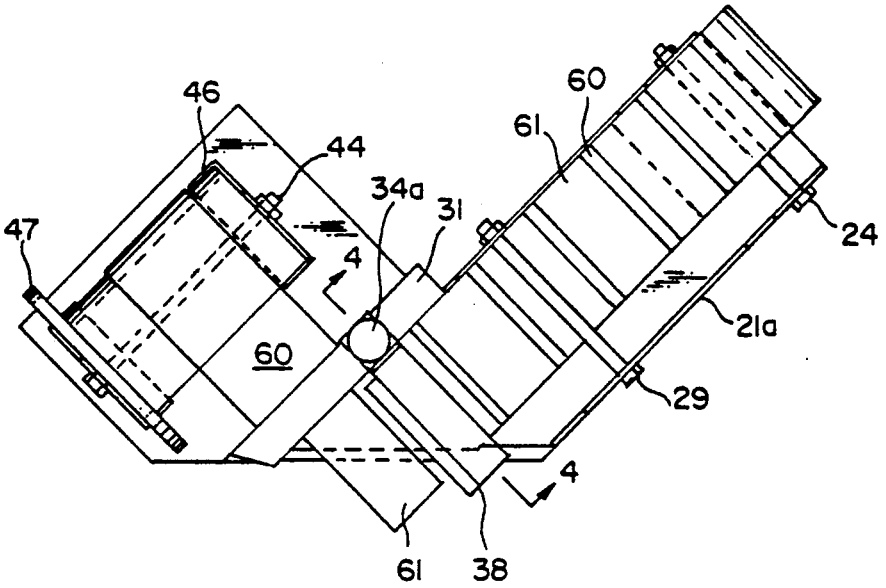
FIG. 2

FIG. 3
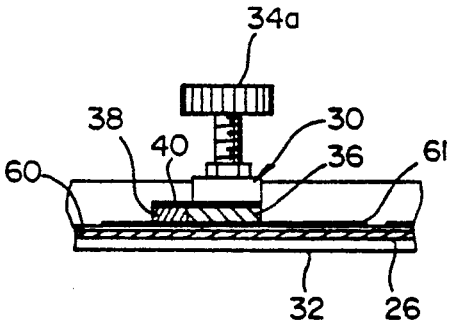
FIG. 4
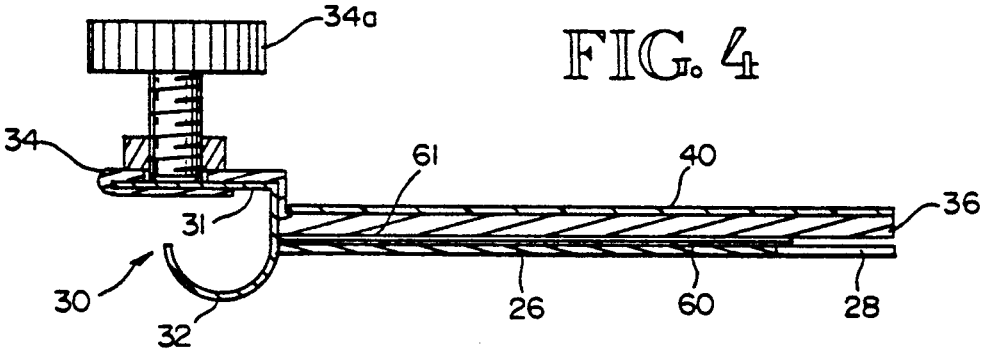
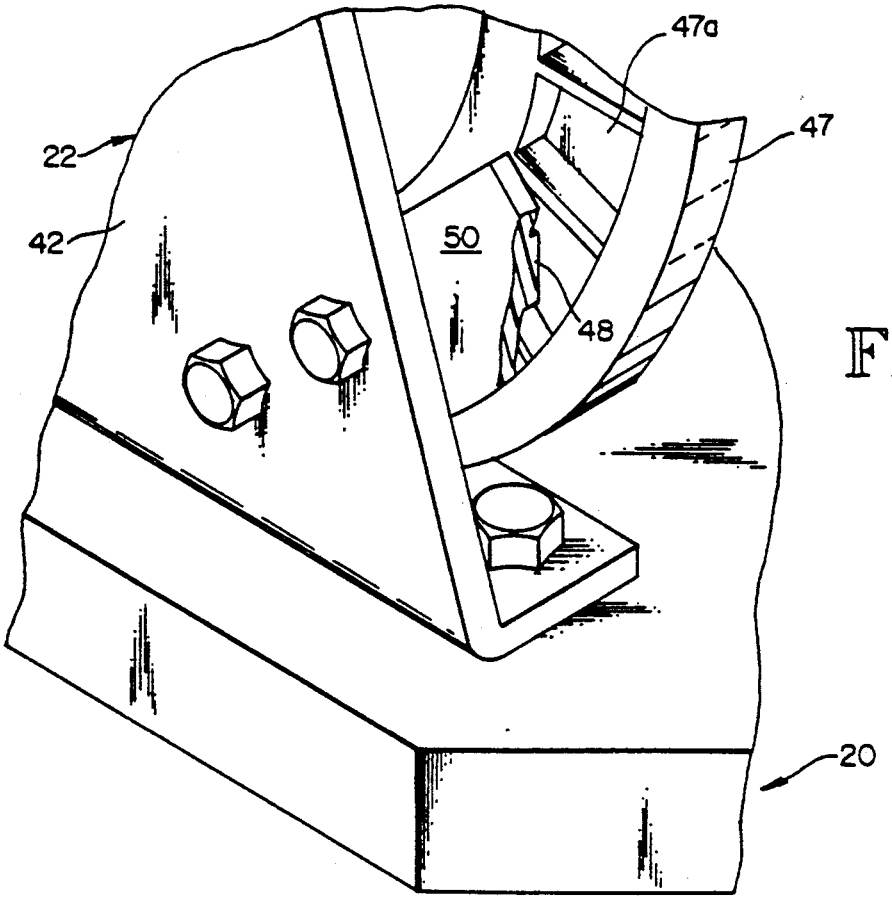
FIG. 5

LABEL DISPENSER

DESCRIPTION

1. Technical Field

The present invention relates to label dispensers of the type in which labels with pressure sensitive adhesive are stripped from a dispensing strip having a release surface engaged by the adhesive, and more particularly, relates to the manner in which the labels are removed from the strip.

2. Background of the Invention

A need has arisen for a simple label dispenser in which the labels can be easily and more rapidly manually stripped from the dispensing strip. In the past this strip has been advanced over a peeling edge extending at right angles to the travel path of the strip to free the labels. Such dispensers provide access to only one label at a time for manual gripping of the labels in preparation for manual application thereof when the labels are arranged side by side along the dispensing strip.

SUMMARY OF THE INVENTION

By the present invention the peeling edge is located at an acute angle to the infeed path of the dispensing strip so that a corner portion of each label is first released from the backing strip and presented for easy manual access. This arrangement permits more than one label at a time to be partially exposed for removal. A magnet holds the label-carrying dispensing strip against a support surface to help create the tension in the dispensing strip needed at the peeling edge to free the labels. The dispensing strip is rolled onto a take-up spool after passing over the peeling edge.

BRIEF DESCRIPTION OF THE DRAWINGS

FIG. 1 is a perspective view of a dispenser made in accordance with the present invention and shown in operation;

FIG. 2 is a top plan view of the dispenser;

FIG. 3 is a vertical sectional view taken as indicated by line 3—3 of FIG. 1;

FIG. 4 is a transverse vertical sectional view to an enlarged scale take as indicated by line 4—4 of FIG. 2; and FIG. 5 is a detail perspective view to an enlarged scale taken as indicated by the FIG. 5 legend in FIG. 1.

DETAILED DESCRIPTION OF THE INVENTION

Referring to the drawings, the dispenser has a frame 20 having an infeed section 21 and a take-up section 2. The infeed section 21 is generally U-shaped in cross-section to provide a pair of cheek plates 21*a* with a raised rear portion slotted at the top at 21*b* to receive a spindle 24. At the front the infeed section 21 supports a flat feed table 26 which projects forwardly and has a leading peeling edge 28 preferably extending at about 30 to 45 degrees to the back edge 26*a* of the table. A cross-bolt 29 extends between the cheek plates above the trailing end of the table to serve as a guide.

Secured along the projecting portion of the back edge 26*a* of the table 26 is a member 30 providing a top slide rail 31 and a bottom downwardly-curved guide flange 32 extending downwardly below the level of the underside of the table 26. Slidably mounted on the slide rail 31 is a clamp 34 having a locking screw 34*a*. An arm 36 extends from the clamp 34 across the table 26 and carries at its leading edge a suitable hold-down element such, for example, a magnetic hold-down element 38 which is attracted by the table 26. This hold-down element 38 is hingedly connected to the arm 36 as by a flexible strip 40 bonded to the top surface of the arm 36 and element 38, and has a gentle hold-down action.

The take-up section 22 has a pair of reel supports 42 each of which has top slots 42*a* to receive a cross shaft 44 on which a take-up reel 46 is mounted. This reel 46 preferably has a radially-enlarged sprocket disc 47 at one end presenting an annular row of ratchet indents 47*a* to act in conjunction with a ratchet pawl 48 presented by a spring finger 50 on the reel support 42. The pawl 48 is adopted to fit into the indents 47*a* to prevent backlash when the reel 46 is turned counterclockwise as viewed in FIG. 1. This turning may be done manually by gripping the rim of the disc 47, by turning a ratchet arm (not shown) fitted onto the shaft 44, or by powering the reel 46.

In FIG. 1 a label dispensing strip 60 on which labels 61 are mounted for release is shown feeding from a roll having a hollow core suspended on the spindle 24. The strip 60 advances beneath the guide 29 onto the table 26 and beneath the magnetic hold-down element 38. When the strip 60 reaches the peeling edge 28 it bends beneath the table 26 so that what had been the front edge 60*a* thereof becomes the back edge as the strip 60 then passes under the guide flange 32 and onto the take-up reel 46.

As the dispensing strip 60 passes over the peeling edge 28 it first peels away from the front corner portion 61*b* of the lead label 61 thereon, thereby exposing this corner portion to be manually gripped and totally stripped from the dispensing strip 60. This arrangement makes it possible to have more than one side-by-side label partially stripped at a time, thereby making it possible to speed up manual removal of the labels from the dispensing strip. The ratcheting of the take-up reel 46 and hold-down action of the magnetic element 38 maintain adequate tension on the strip 60 as it passes over the peeling edge 28. The slide clamp 34 permits the location of the hold-down element 38 to be adjusted relative to the peeling edge 28 in accordance with the width of the dispensing strip 60.

For purposes of example, a single row of labels 61 have been shown on the dispensing strip 60. However, it will be apparent that more than one row can be dispensed in accordance with the invention, and the labels can be wider or narrower than those shown. It will be appreciated that the invention can also be used when the dispensing strip 60 and labels thereon are fan-folded rather than on a roll.

I claim:

1. A label dispenser for stripping adhesive-backed labels from a dispensing strip, comprising:

a frame;

strip supporting means on the frame for supporting a said dispensing strip;

a table on said frame projecting in a longitudinal lead direction from said strip supporting means, said table having a stripping edge at its lead end extending at an acute angle to said lead direction between a back longitudinal table edge and a shorter front longitudinal table edge; and a take-up reel on said frame behind said back longitudinal table edge for receiving a dispensing strip passing rearward beneath said table after removal of labels therefrom responsive to passage of the dispensing strip over said stripping edge after traveling over said table from said strip supporting means.

2. A label dispenser according to claim 1 in which means are provided for keeping said dispensing strip tensioned as it passes over said stripping edge.

3. A label dispenser according to claim 1 in which hold-down means extends across said table between said longitudinal edges thereof for gently holding the dispensing strip against said table adjacent said stripping edge.

4. A label dispenser according to claim 3 in which said hold-down means is magnetic.

5. A label dispenser according to claim 3 in which said take-up reel has ratchet means for preventing movement of the dispensing strip from the reel toward the table.

6. A label dispenser according to claim 3 in which adjustment means is provided for selective placement of said hold-down means along said table.

7. Label dispenser according to claim 1 in which longitudinal guide means is mounted beneath the bottom level of said table adjacent said back longitudinal table edge for engagement by dispensing strip passing from said stripping edge to said take-up reel.

8. A label dispenser according to claim 1 in which said acute angle is about 30 to 45 degrees.

9. A label dispenser according to claim 1 in which said strip supporting means comprises roll mounting means for supporting said dispensing strip when in roll form.

10. A method of stripping adhesive-backed labels from a dispensing strip, comprising:

advancing said strip along a linear infeed path to a stripping edge extending at an acute angle to said path; and passing the advancing strip over said stripping edge and crosswise beneath said path to free labels from the dispensing strip at the stripping edge.

11. A method according to claim 10 in which moderate hold-back pressure is applied to said advancing strip to assist in tensioning the strip as it passes over said stripping edge.

12. A method according to claim 10 in which said acute angle is about 30 to 45 degrees.

13. A method according to claim 10 in which said dispensing strip is gathered on a roll after passing beneath said path.

* * * * *